United States Patent [19]

Röck et al.

[11] Patent Number: 4,800,622

[45] Date of Patent: Jan. 31, 1989

[54] FURNITURE HINGE INCLUDING HINGE ARM RELEASABLY CONNECTED TO A MOUNTING PLATE

[75] Inventors: Erich Röck, Höchst; Helmut Rupprechter; Klaus Brüstle, both of Lauterach, all of Austria

[73] Assignee: Julius Blum Gesellschaft m.b.H., Höchst, Austria

[21] Appl. No.: 878,868

[22] PCT Filed: Oct. 3, 1985

[86] PCT No.: PCT/AT85/00037

§ 371 Date: May 28, 1986

§ 102(e) Date: May 28, 1986

[87] PCT Pub. No.: WO86/02402

PCT Pub. Date: Apr. 24, 1986

[30] Foreign Application Priority Data

| | | | |
|---|---|---|---|
| Oct. 19, 1984 | [AT] | Austria | 3336/84 |
| Oct. 19, 1984 | [AT] | Austria | 3337/84 |
| May 9, 1985 | [AT] | Austria | 1393/85 |
| Aug. 19, 1985 | [AT] | Austria | 2404/85 |

[51] Int. Cl.[4] ..... E05D 7/06

[52] U.S. Cl. ..... 16/240; 16/246; 16/249; 16/382; 16/DIG. 43

[58] Field of Search ..... 16/238, 240, 241, 245, 16/246, 252, 324, 326, 333, 349, 370, 382, 249; 403/327, 330

[56] References Cited

U.S. PATENT DOCUMENTS

| | | | |
|---|---|---|---|
| 3,969,787 | 7/1976 | Rock et al. . | |
| 4,586,399 | 5/1986 | Kassai | 403/330 |

FOREIGN PATENT DOCUMENTS

| | | |
|---|---|---|
| 0043903 | 1/1982 | European Pat. Off. . |
| 2460127 | 6/1976 | Fed. Rep. of Germany . |
| 2614447 | 10/1976 | Fed. Rep. of Germany . |
| 2719890 | 11/1977 | Fed. Rep. of Germany . |
| 2657628 | 6/1978 | Fed. Rep. of Germany . |
| 2806958 | 8/1978 | Fed. Rep. of Germany . |
| 3039328 | 10/1980 | Fed. Rep. of Germany . |
| 3026796 | 1/1982 | Fed. Rep. of Germany . |
| 3119571 | 12/1982 | Fed. Rep. of Germany . |
| 3241284 | 5/1984 | Fed. Rep. of Germany . |
| 3302312 | 7/1984 | Fed. Rep. of Germany . |

*Primary Examiner*—Fred A. Silverberg

*Attorney, Agent, or Firm*—Wenderoth, Lind & Ponack

[57] ABSTRACT

A hinge includes a hinge arm adapted to be snapped onto a mounting plate. The front of the hinge arm is directly or by an intermediate member indirectly engageable into the mounting plate, and the rear of the hinge arm has a tilting lever at which a hook member is formed by which the tilting lever is lockable to the mounting plate. When a door is mounted to the body of an article of furniture, the hinge arm can be engaged into the mounting plate and then fastened thereto simply by applying pressure. Canting of the hinge arm at the mounting plate is prevented.

8 Claims, 17 Drawing Sheets

A
VII
1
2
2''
2'''
6
7
7'
8
9
11
15
16
17
18
19
20
21
22
23
24
25

FURNITURE HINGE INCLUDING HINGE ARM RELEASABLY CONNECTED TO A MOUNTING PLATE

BACKGROUND OF THE INVENTION

The invention relates to a hinge comprising a hinge arm adjustably held on a mounting plate, a joint adjustment screw or the like and an adjustment device acting in the direction of the depth of a piece of furniture on which the hinge is mounted, the hinge arm being lockable on the mounting plate by means of a resilient snap-in mechanism and held on the mounting plate directly or by means of an intermediate member indirectly at two positions along the length of the hinge arm.

In conventional hinges, the hinge arm is fastened to the mounting plate by means of a clamping screw generally projecting through an oblong hole to permit adjustment of the hinge arm in the direction of the depth of the piece of furniture.

Lately, snap-in connections for fastening the hinge arm to the mounting plate have become known. DE-A-30 26 796 and DE-A-30 39 328, for example, each show a hinge with a hinge arm and a fastening plate, wherein such two parts, which are to be interlocked, snap into each other by inserting the hinge arm into a guide of the fastening plate and by displacing the hinge arm in a longitudinal direction. A similar way of anchoring a hinge arm to a mounting plate is shown in DE-A-24 60 127. DE-A-32 41 284 shows a hinge in which the hinge arm is insertable into lateral guides of a mounting plate and clampable to the mounting plate by means of an eccentric.

The afore-described ways of anchoring a hinge arm to a mounting plate have the advantage that the hinge arm can be quickly fastened to the mounting plate during assembling operations and, further, that no tools are required for mounting. Such advantage is not unimportant because when the hinge arms are mounted, a door to which the hinge arm is fastened must be held. If, for example, the door is held with one hand and the hinge arm to be mounted is held with the other hand, a second person is often required to fasten the clamping screw with a screw driver, if the hinge arm is locked by means of a clamping screw.

It is a disadvantage of hinges in which the hinge arm or the intermediate member is insertable into the mounting plate from the front that they easily cant.

This occurs in particular in the case of high doors which carry many hinges. In most cases, the hinge arm has to be displaced almost over the entire length of the mounting plate.

SUMMARY OF THE INVENTION

It is the object of the invention to provide an improved hinge with resilient snap-in locking, wherein depth adjustment of the hinge arm is possible when the hinge arm has already been mounted on the mounting plate, wherein the hinge is of simple construction and wherein the hinge arm is easily mountable onto the mounting plate and releasable therefrom.

According to the invention, this object is achieved by providing that the hinge arm or an intermediate member is engageable with the mounting plate at a first bearing and is pivotable about such first bearing, while the hinge arm intermediate member has at least one resilient catch projection is provided forming a second bearing so that the hinge arm and the mounting plate are held together at this point by means of a snap connection.

An embodiment of the invention provides that the hinge arm is pivotally engaged by means of a joint adjustment screw to that end of the mounting plate which is directed toward the hinge link or links of the hinge, such joint adjustment screw together with projections of the mounting plate forming the pivot bearing, and that there is provided on the hinge arm and/or on the mounting plate a holding clamp which is resilient or acted upon by a spring and holds the end of the hinge arm pivotable about the pivot bearing of the hinge arm by engaging in a second holding clamp or in a stop member of the corresponding hinge part.

A holding clamp preferably is held on the hinge arm by means of a clamping screw and has two flanges aligned parallel to the pivot axis of the hinge, one of such flanges engaging in a groove of the mounting plate, and the other of such flanges having a slot or the like into which projects a flange of the second holding clamp that is on the mounting plate.

An embodiment of the invention provides that the second holding clamp has a resilient bent double flange by means of which the holding clamp is inserted into the mounting plate in a clamping manner.

It is advantageously provided that the double flange contacts the mounting plate at three positions which are disposed in triangular arrangement in the cross-section of the mounting plate.

A further embodiment of the invention provides that the holding clamp held on the hinge arm by means of the clamping screw has lateral holding members which engage in lateral grooves of the mounting plate, said grooves advantageously extending towards the front end face or obliquely forwardly to the top face of the mounting plate, and that the holding clamp is provided with a stop flap which rests resiliently on the rear end face of the mounting plate or on a corresponding projection.

One embodiment of the invention provides that the holding clamp held on the hinge arm by means of the clamping screw engages in a rearwardly extending projection of the mounting plate.

It is advantageously provided that the holding clamp has a slot through which projects a clamping screw mounted in a female thread of the mounting plate, and that such slot in the holding clamp is open and, thus, forms two legs with external tabs or lugs engaging in recesses in lateral flanges of the hinge arm.

A further embodiment of the invention provides that the holding clamp is a slide acted upon by a spring guided in guides of the mounting plate and having a hole through which a bolt fastened to the hinge arm and having a lateral groove projects, such slide having edges engaging in such groove.

Another embodiment of the invention provides that the hinge includes a tilting member pivotally mounted on the intermediate member.

It is advantageously provided that the tilting lever has a nose lying opposite a resilient projection and pressing on the mounting plate when the tilting lever is disengaged.

To obtain a particularly firm fit of the hinge arm on the mounting plate, the clamping screw for the depth adjustment arranged between the first and the second bearings has a centering portion or shoulder projecting into a corresponding recess or opening of the mounting plate.

BRIEF DESCRIPTION OF THE DRAWINGS

In the following embodiments of the invention will be described in more detail with reference to the accompanying drawings, wherein.

Figure 1:
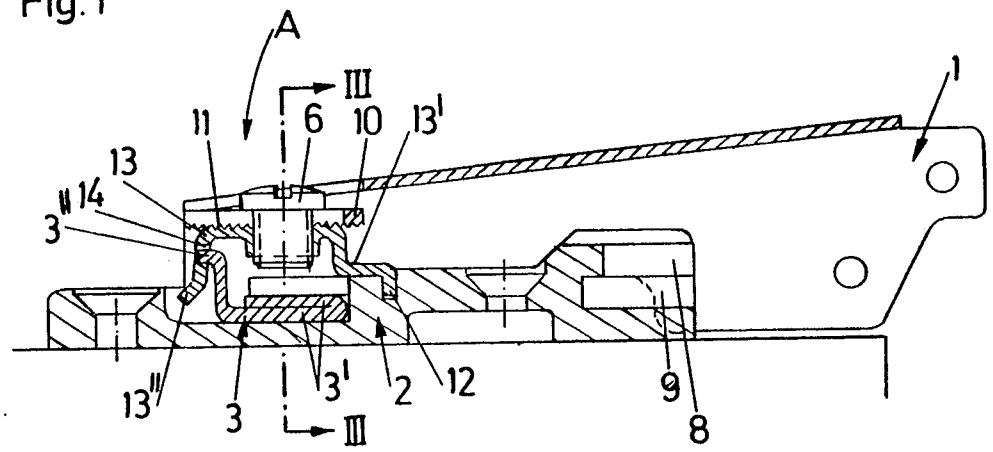
FIG. 1 is a longitudinal sectional view of one embodiment of a hinge arm and a mounting plate in the mounted position.
Figure 3:
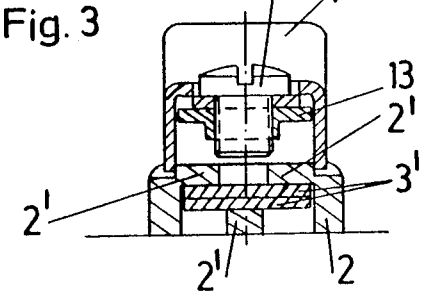
FIG. 3 is a cross-sectional view of such hinge arm and mounting plate.
Figure 2:
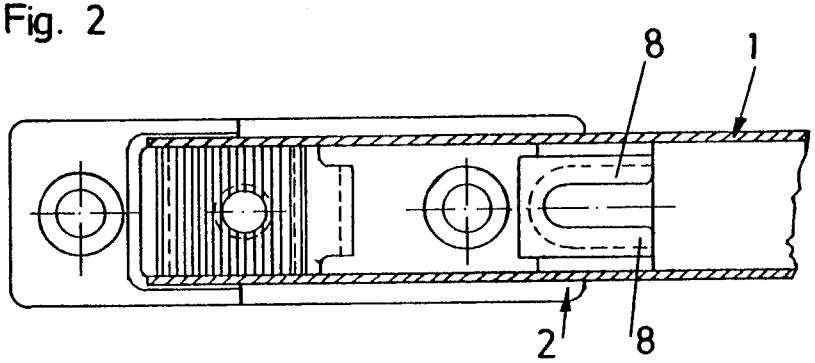
FIG. 2 is a top view of such mounting plate and hinge arm, parts thereof being shown in section.
Figure 4A:
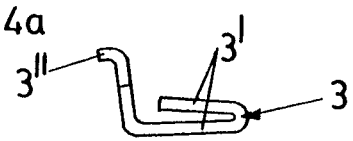
FIGS. 4*a* and 4*b* are a side view and a top view respectively of a holding clamp thereof.
Figure 4B:
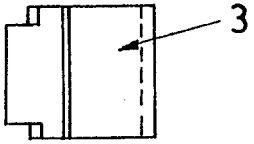

Various of the hinge parts, such as the hinge casing and hinge links, that are not directly related to the present invention are not shown in the drawings, since they may have any structure in accordance with the state of the art.

DETAILED DESCRIPTION OF THE INVENTION

In the embodiment according to FIGS. 1 to 5, a resilient holding clamp 3 is inserted in a mounting plate 2. The holding clamp 3 has a double flange 3' which rests against pressure faces 2' of the mounting plate 2 which are disposed in a triangular arrangement, the flanges 3' of the holding clamp thus being pressed together. The holding clamp 3 thereby is, relatively firmly held in the mounting plate 2.

At the front, i.e. at an end directed toward a hinge link, a hinge arm 1 is in a conventional manner provided with a joint adjustment screw 7 which is mounted in a female thread in the hinge arm 1 and is held with a head 7' thereof behind projections 8 of the mounting plate 2. The joint adjustment screw is tiltable in a recess 9 which is limited and defined between the projections 8.

The rear end arm 1 has punched from the material of a center flange thereof a flap 10 in which is formed a rearwardly open slot 11 through which projects a clamping screw 6. A holding clamp 13 is held by the clamping screw 6. Holding clamp 13 has a flange 13' having an edge engaging in a groove 12 of the mounting plate 2. The groove 12 and the edge of the flange 13' received therein are aligned parallel to the pivot axis of the hinge.

Opposite the flange 13', i.e. directed to the rear end of the hinge arm 1, the holding clamp 13 has a flange 13'' which is provided with a slot 14. In the mounted position, the flange 3'' of the holding clamp 3 projects into the slot 14.

Figure 5:
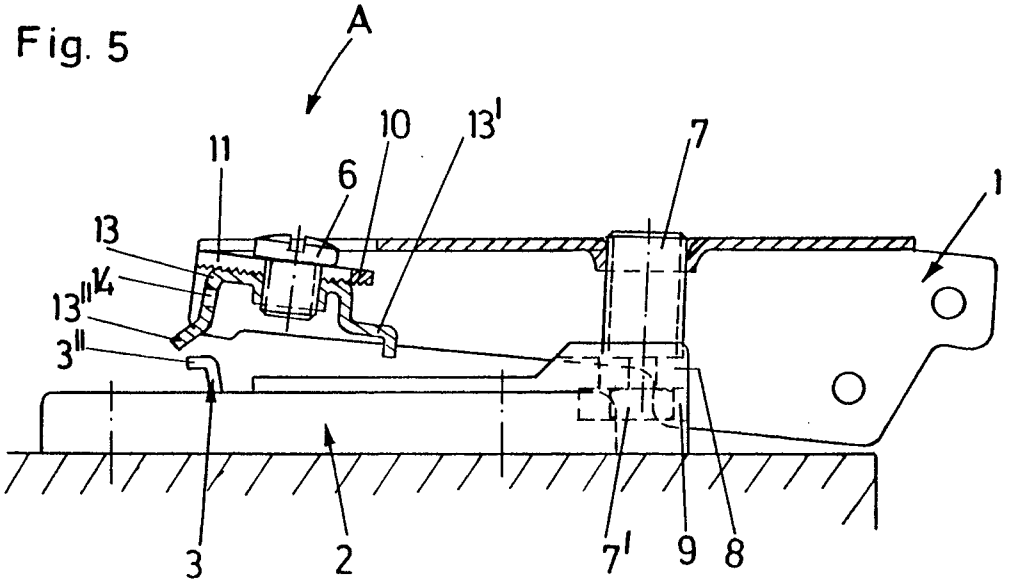
FIG. 5 is a longitudinal sectional view of such hinge arm in a position immediately before being engaged on the mounting plate.

As can be seen from FIG. 5, for a mounting operation, the hinge arm 1 with the joint adjustment screw 7 is manipulated to insert head 7' into the recess 9, and then is pivoted in the direction of arrow A about the head 7' of the joint adjustment screw 7 which serves as a pivot bearing or axis, thus pressing the holding clamp 13 onto the holding clamp 3. In the final mounting position, the flange 3'' of the clamp 3 engages in the slot 14 of the flange 13'' of the holding clamp 3, and, as already mentioned, the free edge of the flange 13' of the holding clamp 13 projects into the groove 12 of the mounting plate 2. Hence, the hinge arm 1 is securely anchored to the mounting plate 2. If an adjustment in the direction of the door joint is necessary, the joint adjustment screw 7 need only be turned in a conventional manner. The hinge arm 1 can adapt itself to any angular position because of the resilience of the flap 10.

For an adjustment of the hinge arm 1 in a direction of the depth of the piece of furniture, the clamping screw 6 is released, whereupon the hinge arm 1 can be displaced over the length of the slot 11 and over the depth of the recess 9. After such adjustment, the clamping screw 6 again is fastened.

To release the hinge arm 1 from the mounting plate 2, it will be sufficient to press the flange 3" of the holding clamp 3, e.g. together by means of a screw driver, in a direction to be released from slot 14. The clamping screw 6 may also be loosened, and the hinge arm 1 pulled forwardly to release slot 14 from flange 3".

Figures 6, 7, 8:
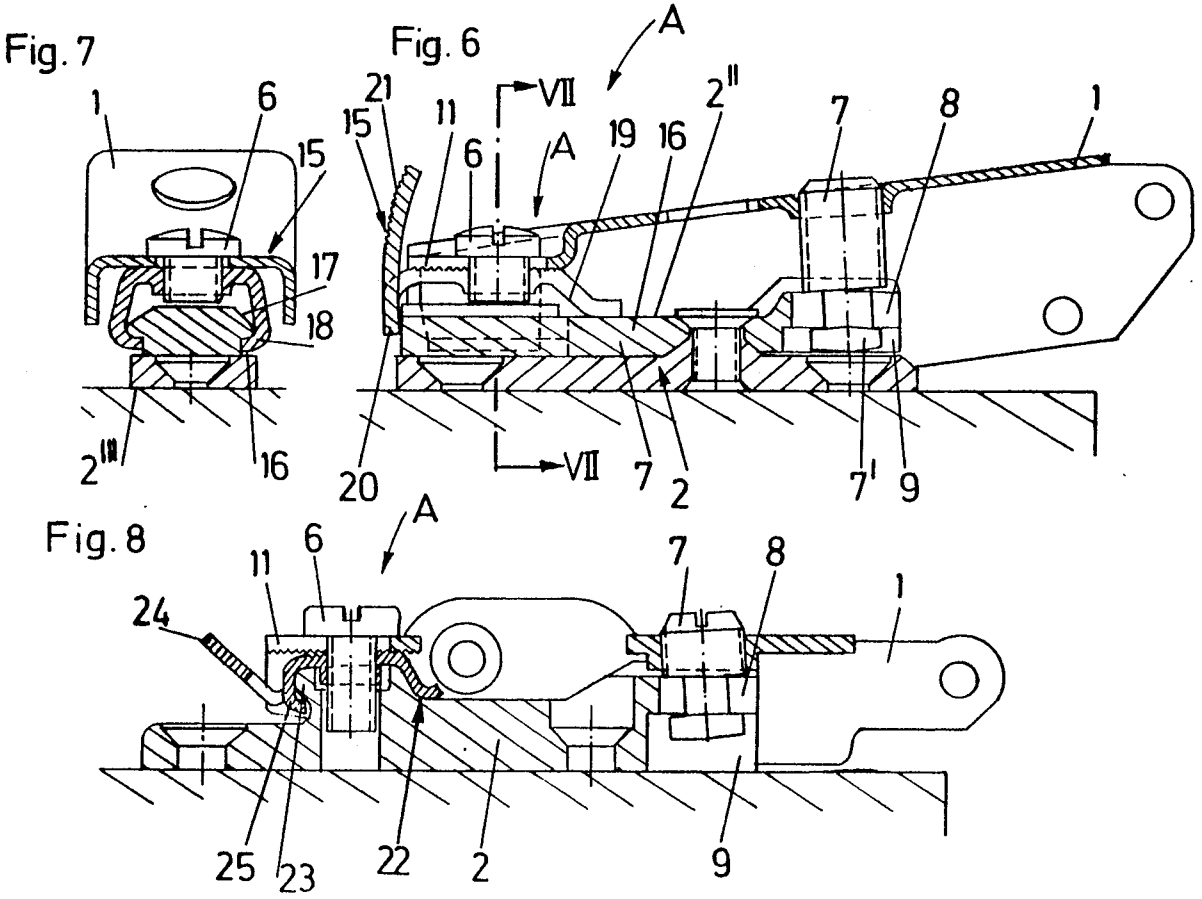
FIG. 6 is a longitudinal sectional view of the hinge arm and the mounting plate of a further embodiment of the invention.
FIG. 7 is a sectional view along line VII—VII of FIG. 6, FIGS. 8 to 11 are longitudinal sectional views of hinge arms and mounting plates according to still further embodiments of the invention.

In the embodiment according to FIGS. 6 and 7, only one holding clamp 15 is used. The hinge arm is, like in the afore-described embodiment, provided with a joint adjustment screw 7 whose head 7' projects into a recess 9 limited by projections 8.

At its rear end, the hinge arm 1 again is provided with a rearwardly open slot 11.

In its rear region, the mounting plate 2 has lateral grooves 16 which extend forwardly and to the top face 2" of the mounting plate 2. Above the lateral grooves 16, the mounting plate 2 has oblique faces 17 which diverge towards the mounting plane 2"' of the mounting plate 2. The holding clamp 15 has lateral holding members 18 which engage in the grooves 16 of the mounting plate 2 when the hinge arm 1 is in the mounted position. The holding clamp 15 is further provided with a resilient flange 19 which rests against the top face 2" of the mounting plate 2 and presses thereon when the hinge arm 1 is in the mounted position.

The holding clamp 15 further has a stop flap 20 which rests against the rear end face of the mounting plate 2. A handle member 21 is formed at the holding clamp 15 above the stop flap 20, or is punched out of the material of holding clamp 15. The holding clamp 15 is, like in the afore-described embodiment, fastened to the hinge arm 1 by means of a clamping screw 6.

For mounting, the hinge arm 1 is, like in the afore-described embodiment, anchored to the mounting plate 2 by means of the head 7' of joint adjustment screw 7 which is pushed into the recess 9, and then is turned in the direction of arrow A.

The holding members 18 move laterally over the oblique faces 17 and snap into the lateral grooves 16 of the mounting plate 2. Due to the fact that the resilient flange 19 presses onto the mounting plate 2, the hinge arm 1 is fixed without clearance.

The adjustments of the hinge arm 1 in the directions of the door joint and the depth of the piece of furniture are effected in the same way as in the afore-described embodiment by turning the joint adjustment screw 7 and by opening the clamping screw 6 and displacing the hinge arm 1.

If the hinge arm 1 is to be lifted from the mounting plate 2, either the clamping screw 6 can be released, whereupon the hinge arm 1 is pulled out, or the handle member 21 is pressed forwardly, thus lifting the stop flap 20 from the end face of the mounting plate 2. Then, the hinge arm 1 can be moved obliquely upwardly along the grooves 16 and pulled forwardly off the mounting plate 2.

In the following embodiments, reference is made only to the rear anchoring of the hinge arm 1 to the mounting plate 2. In all arrangements, the front anchoring by means of the head of joint adjustment screw 7 engaging in recesses 9 limited by projections 8 is the same. In all cases, mounting of the hinge arm 1 on the mounting plate 2 is effected by first engaging the hinge arm 1 into the mounting plate 2 by means of the joint adjustment screw 7, then turning the hinge arm in the direction of arrow A and pressing it onto the mounting plate 2.

In the embodiment according to FIG. 8, the clamping screw 6, which again extends through a rearwardly open slot 11 of the hinge arm 1, supports a holding clamp 22 which extends behind a rearwardly extending projection 23 of the mounting plate 2 and engages behind projection 23 when the hinge arm 1 is in the mounted position.

Figure 9:
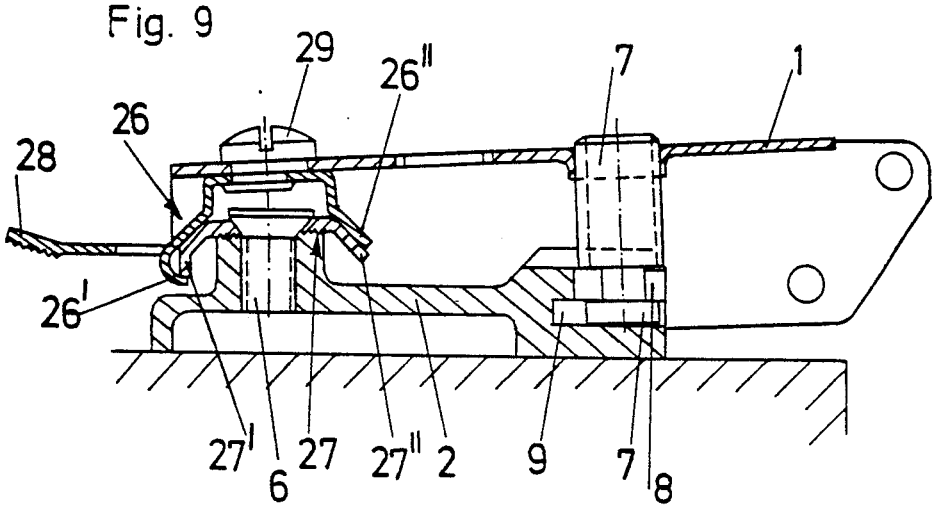

A handle member 24 is formed on the holding clamp 22 by means of which a lever 25 of the holding clamp 22 can be pressed away from the projection 23 to release the hinge arm 1 from the mounting plate 2. For mounting, the hinge arm 1 need only be pressed onto the mounting plate 2 by means of the holding clamp 22. In the embodiment according to FIG. 9, the hinge arm 1 is provided with a holding clamp 26, and a holding clamp 27 is fastened to the mounting plate 2. When the hinge arm 1 is in the mounted position, the holding clamp 26 is pressed onto the holding clamp 27, and has one flange 26' extending behind a flange 27' of the holding clamp 27 and another flange 26" pressed onto a flange 27" of the holding clamp 27. Thus, a firm fit of the hinge arm 1 on the mounting plate 2 is obtained again.

The holding clamp 26 is provided with a handle member 28 which is formed by a flap punched from the material of clamp 26. By means of the handle member 28, the flange 26' can be lifted from the flange 27' of the holding clamp 27, and the hinge arm 1 then is freely movable with respect to the mounting plate 2.

The holding clamp 26 is fastened to the hinge arm 1 by means of an eccentric 29. By turning the eccentric 29, the hinge arm 1 is adjusted in the direction of the depth of the piece of furniture. The holding clamp 27 is held by the screw 6.

Figure 10:
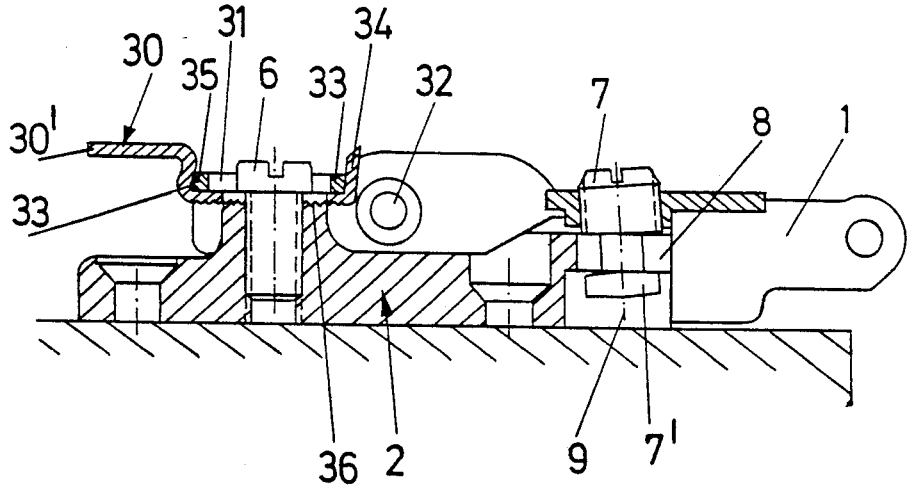

In the embodiment according to FIG. 10, a holding clamp 30 is fastened to the mounting plate 2 by means of the clamping screw 6. The hinge arm 1 has recesses 31,32 and flanges 33 which extend between lateral flanges of the hinge arm 1 that thus has a U-shaped profile.

The holding clamp 30 has upwardly projecting portions 34, 35, portion 35 being directed obliquely to the hinge arm 1.

For mounting, the hinge arm 1 is again pressed onto the holding clamp 30 about the pivot bearing formed by the joint adjustment screw 7 and engages with its flanges 33 behind the portions 34,35 of the holding clamp 30.

The holding clamp 30 is provided with a slot 36, so that the adjustment of the hinge arm 1 in the direction of the depth of the piece of furniture can be effected in a conventional manner by releasing the clamping screw 6, whereupon the hinge arm 1 can be displaced over the length of the slot and the depth of the recess 9.

Figure 11:
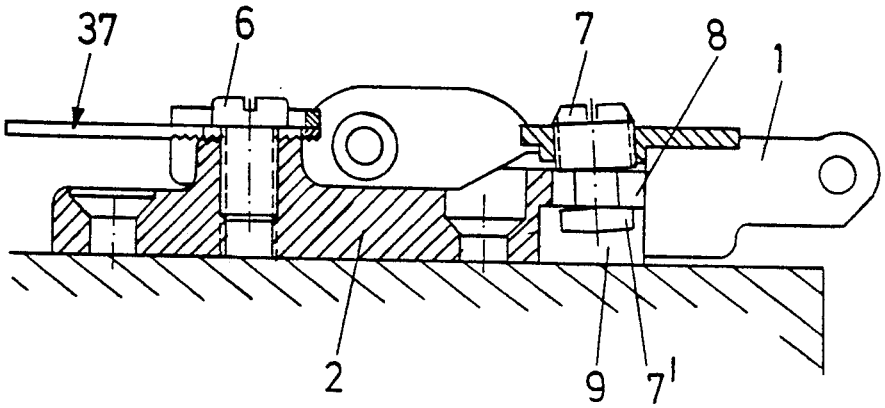
Figure 12:
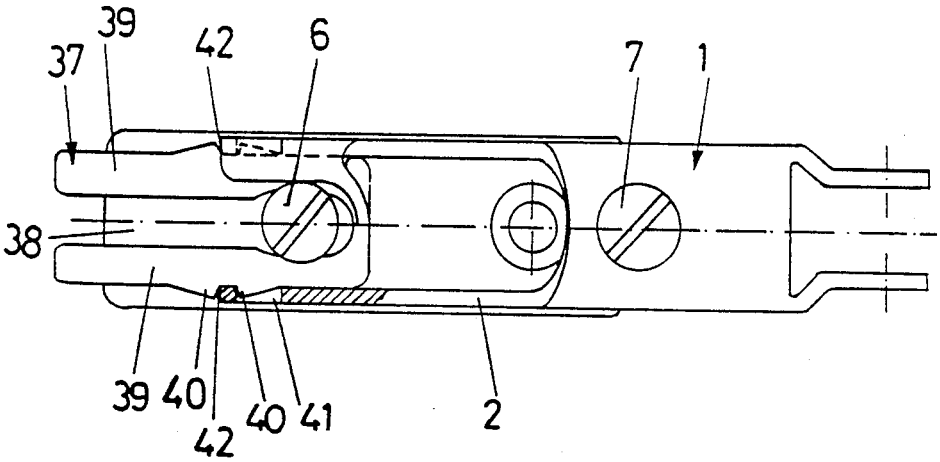
FIG. 12 is a top view of the hinge arm and the mounting plate according to FIG. 11, parts thereof being shown in section.

In the embodiment according to FIGS. 11 and 12, the holding clamp 37 is again fastened to the mounting plate 2 by means of the clamping screw 6. The holding clamp 37 is provided with an open slot 38 defined between two legs 39. External tabs 40 are formed on each leg 39 and engage in recesses 41 when the hinge arm 1 is in the mounted position. Recesses 41 are, for example, rectangular holes in mounting plate 2. The rear end of hinge arm 1 has flanges 42 which are embraced by tabs 40, when the hinge arm 1 has been pivoted onto the mounting plate 2. The holding clamp 37 is resilient so that the legs 39 can be pressed together, thus releasing the flanges 42. Then the hinge arm 1 can be pulled from the mounting plate 2. Adjustment in the depth of the direction of the piece of furniture is possible because of the slot 38.

Figure 13:
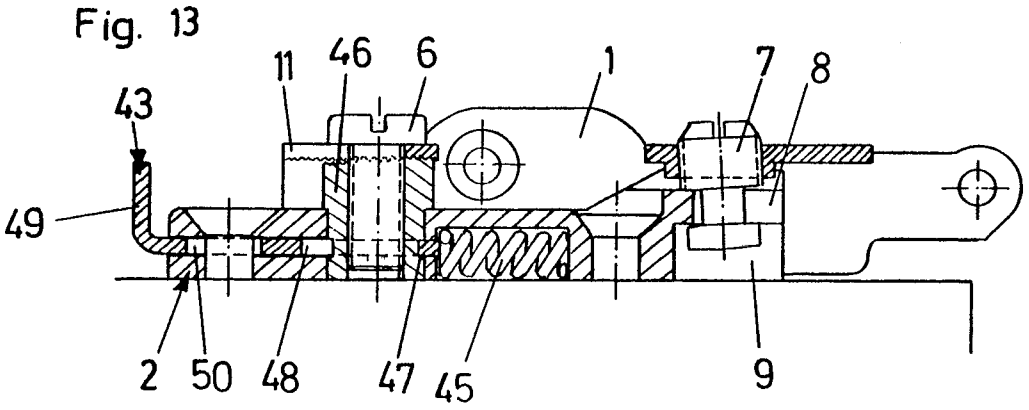
FIG. 13 is a longitudinal sectional view of the hinge arm and the mounting plate of a yet further embodiment of the invention.
Figure 14:
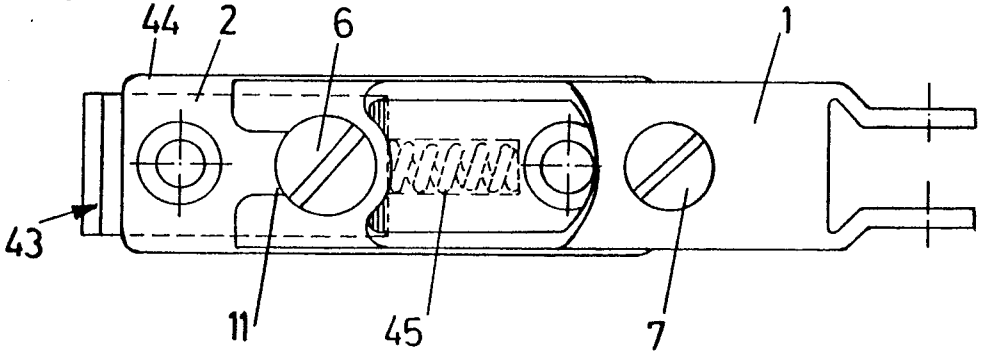
FIG. 14 is a top view of the hinge arm and the mounting plate according to FIG. 13, parts thereof being shown in section.

In the embodiment according to FIGS. 13 and 14, the holding clamp 43 is a slide which is guided in guides 44 of the mounting plate 2. The slide 43 is acted upon by a coil spring 45 arranged in a housing of the mounting plate 2.

A bolt 46 having an annular groove 47 is fastened to the hinge arm 1 by means of the clamping screw 6. The clamping screw 6 projects through a rearwardly open slot 11 in the hinge arm 1.

The holding clamp 43 formed by the slide has a keyhole 48 through which the bolt 46 projects when the hinge arm 1 is in the mounted position. At the rear end, the holding clamp 43 is provided with a handle member 49. The holding clamp 43 has a further slot 50 through which projects a fastening screw for the mounting plate 2.

When the hinge arm 1 is pivoted onto the mounting plate 2, either the holding clamp 43 is pressed by hand against the spring 45 so that the bolt 46 can be pushed into the keyhole 48, or the bolt 46 has at its free end a shoulder in the shape of a truncated cone which presses the holding clamp 43 automatically back against the force of spring 45.

When the bolt 46 is in the position shown in FIG. 13, the spring 45 pushes such that holding clamp 43 with the edges of the keyhole 48 extend into the annular groove 47 of the bolt 46, whereupon the direction of the hinge arm 1 is firmly and securely held on the mounting plate 2.

The adjustment of the hinge arm 1 in the direction of the door joint and in the depth of the piece of furniture are effected as in the afore-described embodiments.

For releasing the hinge arm 1, the holding clamp 43 is pressed forwards by means of the handle member 49, whereupon the bolt 46 is pivoted out of the keyhole 48. It is obviously also possible to release the clamping screw 6 and pull the hinge arm 1 out between the clamping screw 6 and the bolt 46.

Figure 15:
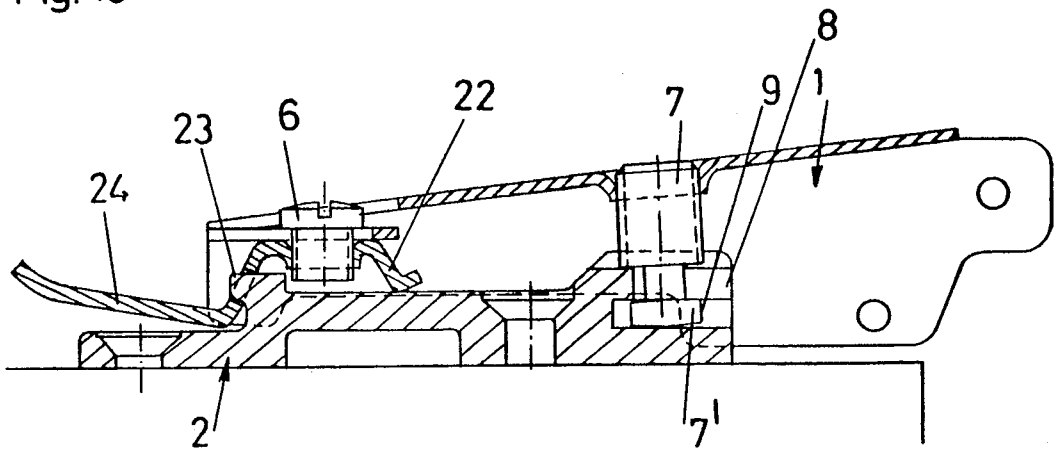
FIGS. 15 and 16 are longitudinal sectional views of hinge arms and mounting plates of two further embodiments of the invention.

In the embodiment according to FIG. 15, the holding clamp 22 engages at the projection 23.

Figure 16:
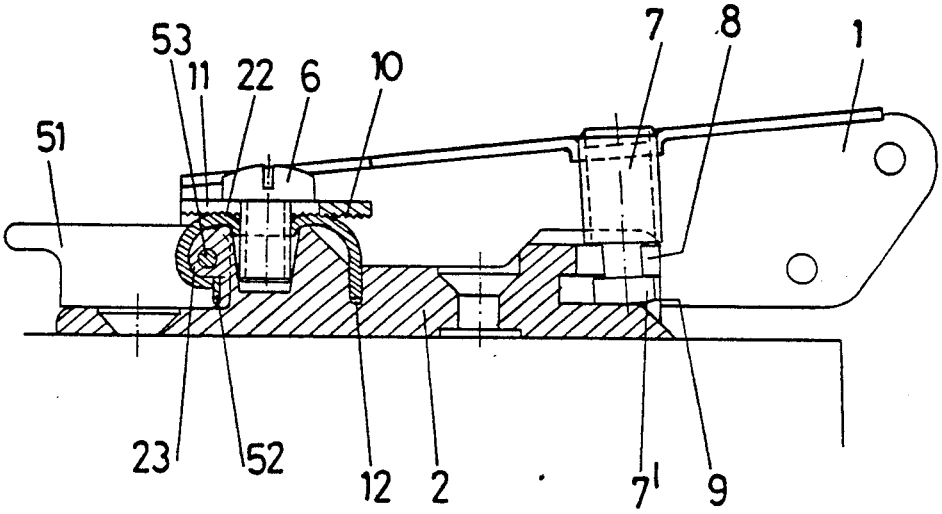
Figure 17:
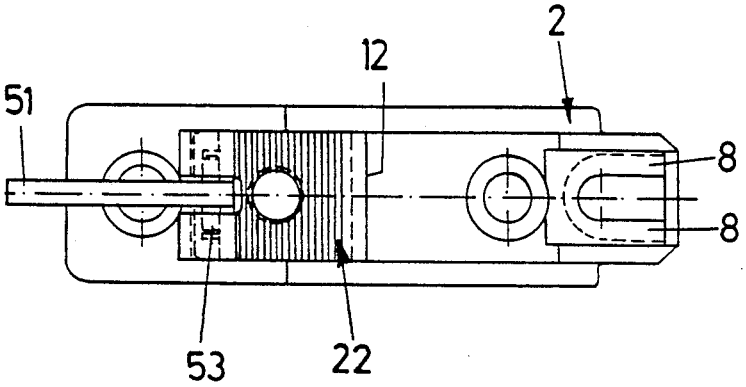
FIG. 17 is a top view of the mounting plate according to FIG. 16.
Figure 18:
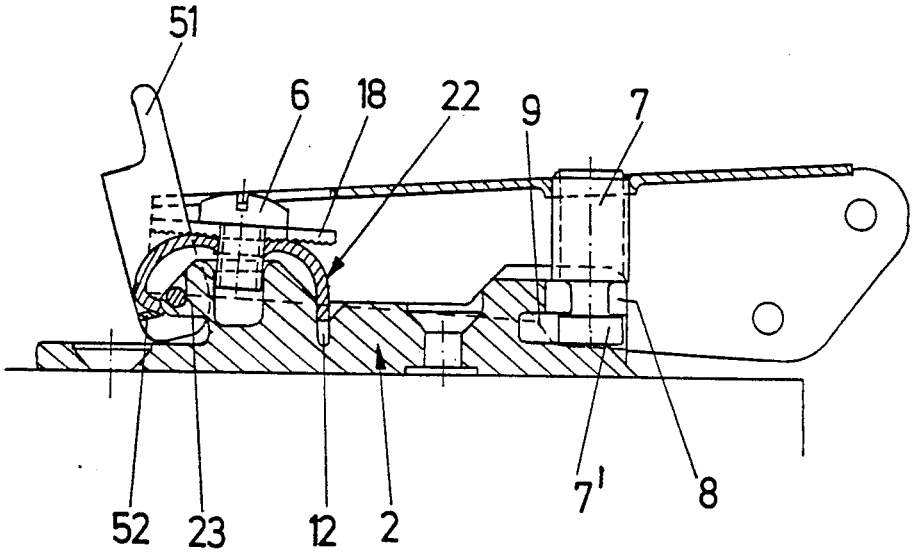
FIG. 18 is a view similar to FIG. 16, the hinge arm being in a released position.

In the embodiment according to FIGS. 16 to 18, the holding clamp 22 extends, on the one side, behind the projection 23 at the rear side of the mounting plate 2 and projects, on the other side, into a groove 12. At the rear end of the mounting plate 2 a latch 51 is pivotally mounted on an axle 53. The latch 51 is provided with a stop 52.

The hinge arm 1 is mounted on the mounting plate 2 as in the afore-described embodiments, i.e. it is engaged in the mounting plate 2 by means of the joint adjustment screw 7 so that the holding clamp 22 engages at the projection 23.

The adjustments of the hinge in the direction of the depth of the piece of furniture and in the direction of the width of the door joint are effected as in the afore-described embodiments.

For releasing the hinge arm 1, the latch 51 is pressed upwardly, as shown in FIG. 18, such that the rear leg of the holding clamp 22 is thus pulled away from the projection 23, and the hinge arm 1 is thus released.

In the embodiment according to FIGS. 19 to 23, the parts which are essential to the invention are the hinge arm 1, the mounting plate 2 and an intermediate member 4 with a tilting member or pivot lever 5.

The hinge arm 1 is fastened to the intermediate member 4 by means of the joint adjustment screw 7, which is mounted in a female thread in the hinge arm 1, and by means of a clamping screw 6 which also serves for depth adjustment. The clamping screw 6 projects through a slot in a web of hinge arm 1, and the joint adjustment screw 7 has head 7' held in a recess in the form of an open slot 9 in a web of intermediate member 4. By releasing the clamping screw 6, the hinge arm 1 can be displaced over the length of the slot, and thus, be adjusted in the direction of the depth of the piece of furniture. The adjustment in the direction of the door joint is effected in a conventional manner by turning the joint adjustment screw 7.

The mounting plate 2 as well as the intermediate member 4 have U-shaped profiles, and legs 2' of mounting plate 2 extend into legs 4' of intermediate member 4 when the hinge arm 1 has been mounted.

At its front, the intermediate member 4 is provided with a through bolt 63 which serves as a holding projection of the intermediate member 4. The legs of flanges 2' of the mounting plate 2 have notches 53 into which the bolt 63 can be inserted so that it is held behind the edge projections of the flanges 2'.

The bolt 63 and the notches 53 fulfill the function of the joint adjustment screw 7 and of the recess 9 of the afore-described embodiments.

At its rear end, the mounting plate 2 is also provided with notches 54.

The tilting member 5 is mounted at the rear end of the intermediate member 4 by means of a pivot pin. A resilient holding projection 57, also formed by a bolt, is provided on the tilting member 5.

The tilting member 5 is acted upon by a leg or torsion spring 64 which is wound around the pivot pin of the tilting member 5 and which has one leg 64' abutting on the intermediate member 4 and with the other leg 64" on the bolt 57.

Figure 19:
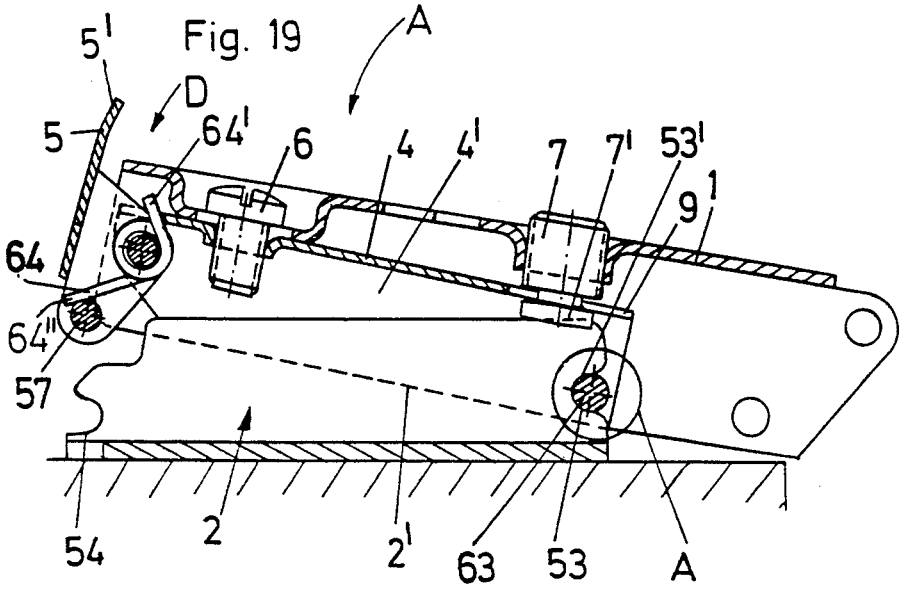
FIG. 19 is a longitudinal sectional view of a hinge arm in the released position.
Figure 20:
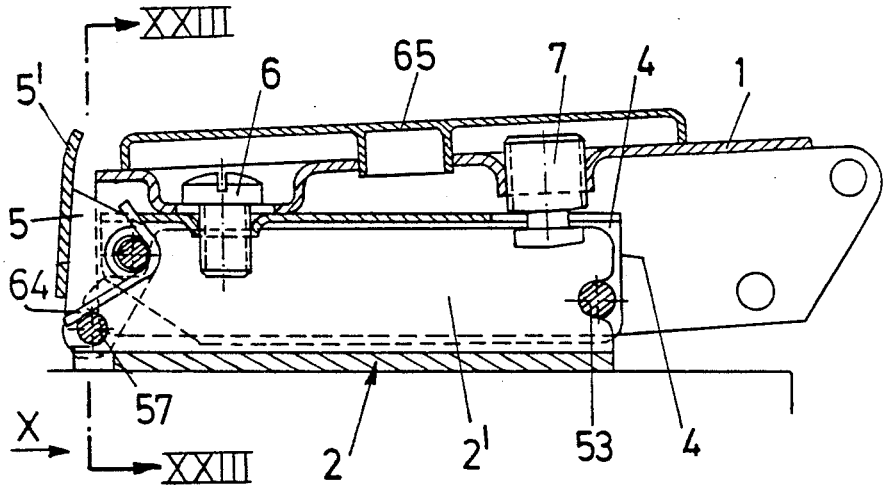
FIG. 20 is a longitudinal sectional view, with the hinge arm being in an anchored position.

When the hinge arm 1 with the intermediate member 4 is pressed from the position shown in FIG. 19 into the position shown in FIG. 20, the bolt 57 engages in the notch 54, and the hinge arm 1 is anchored to the mounting plate 2.

The adjustment of the hinge arm 1, is, if required, effected in the afore-described manner.

A cover cap 65 may be provided the hinge arm 1 to cover the clamping screw 6 and the joint adjustment screw 7 when the adjustment has been effected.

A handle member 5' is formed on the tilting member 5. If the hinge arm 1 is to be released from the mounting plate 2, it will be sufficient to press upon handle member 5', whereupon the bolt 57 moves out of the notch 54, and the hinge arm 1 and the intermediate member 4 can be lifted from the mounting plate 2.

Figure 21:
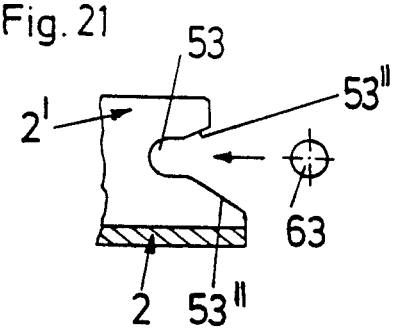
FIG. 21 is a detail of portion A of FIG. 19.
Figure 22:
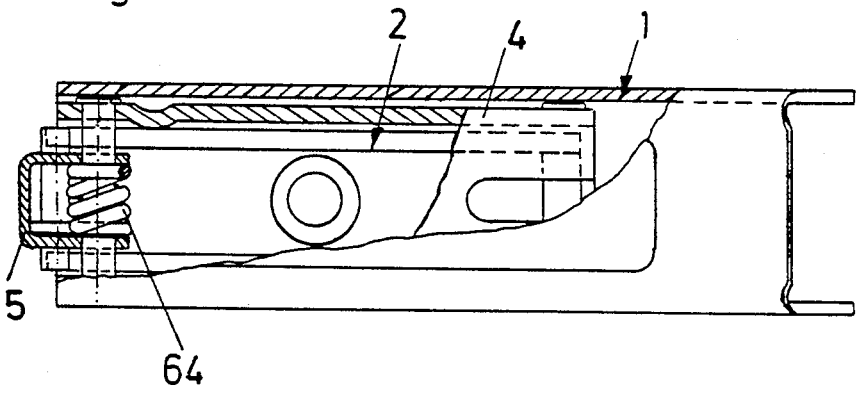
FIG. 22 is a top view of such hinge arm and the mounting plate, parts thereof being shown in section, FIG. 23 on the left side is a sectional view along line XXIII—XXIII of FIG. 20 and and on the right side is an end view in the direction of arrow X of FIG. 20.
Figure 23:
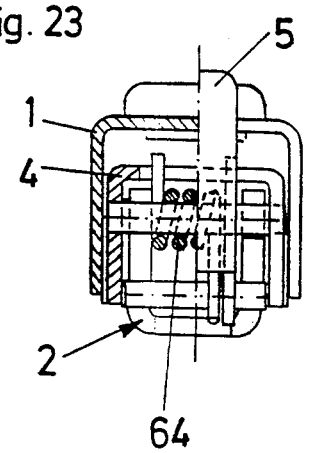

FIG. 21 shows a notch 53 having guide edges 53" which facilitate the insertion of the intermediate member 4 in the mounting plate 2.

Figure 24:
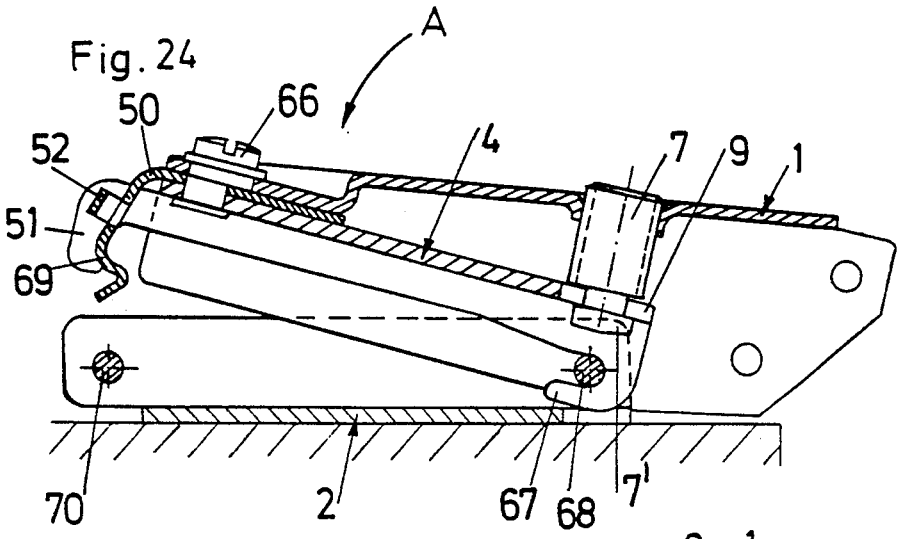
FIG. 24 is a view similar to FIG. 19, but of a further embodiment of the invention.
Figure 25:
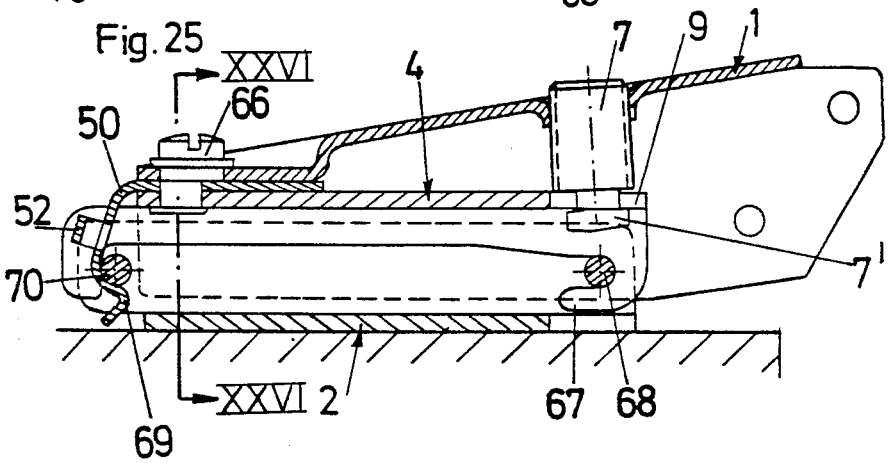
FIG. 25 is a longitudinal sectional view of the hinge arm and the mounting plate of FIG. 24, but, with the hinge arm being in the anchored position.
Figure 26:
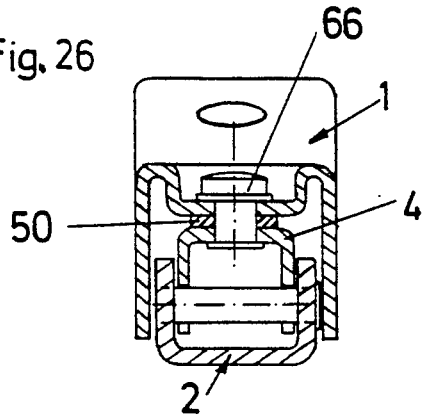
FIG. 26 is a sectional view along line XXVI—XXVI of FIG. 25.

In the embodiment according to FIGS. 24 to 26, a leaf spring 50 is held on the intermediate member 4, i.e. clamped between the intermediate member 4 and the hinge arm 1. The intermediate member 4, the leaf spring 50 and the hinge arm 1 are connected by means of an eccentric 66 which also permits depth adjustment of the hinge arm 1.

In its front region, the hinge arm 1 is, as in the afore-described embodiment, anchored by means of the joint adjustment screw 7 having a head 7' projecting through an open slot forming recess 9 in the intermediate member 4.

The adjustments of the hinge arm 1 in the direction of the door joint and in the direction of the depth of the piece of furniture is effected by turning the joint adjustment screw 7 and the eccentric 66, respectively.

At its front, the intermediate member 4 has hooks 67 by means of which the intermediate member 4 is engageable with a journal 68 of the mounting plate 2. The hooks 67 and the journal 68 form rigid holding projections at the intermediate member 4 and at the mounting plate 2.

The leaf spring 50 has an angular portion 69 which embraces a journal 70 when the hinge arm 1 has been pressed onto the mounting plate 2. The angular portion 69 forms a resilient holding projection of the intermediate member 4.

As in the afore-described embodiments, the hinge arm 1 need only be positioned with the hooks 67, engaging journal 68 and then be pivoted in the direction of arrow A and pressed onto the mounting plate 2, whereupon the leaf spring 50 holds the rear part of the hinge arm 1 in clamped position against the journal 70.

To facilitate releasing of the hinge arm 1 from the mounting plate 2, the leaf spring 50 has a punched flap 52 into which a screw driver can be inserted to press the angular portion 69 downwardly away from the journal 70.

Figure 27:
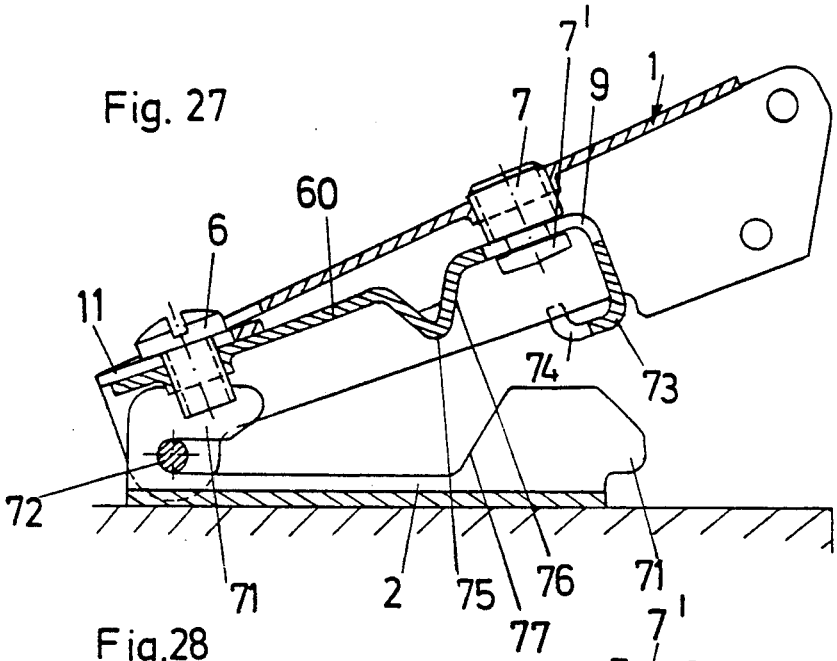
FIG. 27 is a view analogous to FIGS. 19 and 24, but of a further embodiment of the invention.
Figure 28:
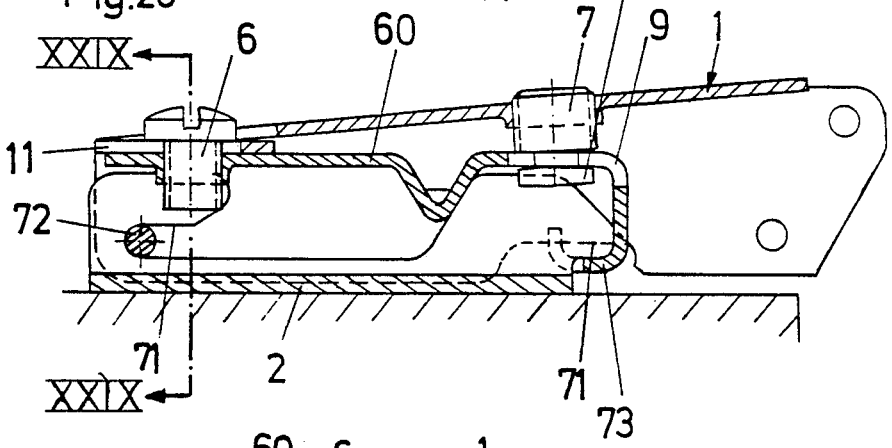
FIG. 28 is a longitudinal sectional view of the hinge arm and mounting plate of FIG. 27, but, with the hinge arm being in the mounted position.
Figure 29:
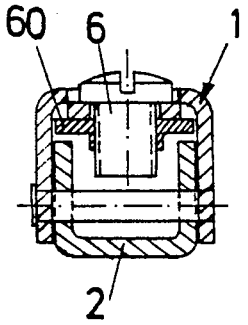
FIG. 29 is a sectional view along line XXIX—XXIX of FIG. 28.

In the embodiment according to FIGS. 27 to 29, the intermediate member is a leaf spring 60. The leaf spring 60 is connected to the hinge arm 1 by means of a clamping screw 6 and a joint adjustment screw 7, the clamping screw 6 projecting through a rearwardly open slot 11 of the hinge arm 1, and the joint adjustment screw 7 having a head 7' projecting through a forwardly open slot of the leaf spring 60, which slot forms the recess 9 so that a depth adjustment of the hinge arm 1 is possible.

The mounting plate 2 has hook-like parallel projections 71 at its front and rear ends. The hinge arm 1, which has a U-shaped profile, is provided at its rear end with a journal 72 which is engageable with the hooks 71 at the rear end of the mounting plate 2. The journal 72 and the rear hooks 71 of the mounting plate 2 form rigid holding projections of the hinge.

In its front region, the leaf spring 60 is provided with an angular portion 73 which engages below the front projections 71 of the mounting plate 2 when the hinge arm 1 has been pushed onto the mounting plate 2, and thus the hinge arm 1 is again anchored to the mounting plate 2.

The angular portion 73 of the leaf spring 60 is advantageously provided with a recess 74.

The leaf spring 60 further has a V-shaped portion 75 having legs 76 pressing against a counterface 77 on the mounting plate 2.

In the following, the embodiment according to FIGS. 30 to 32 will be described.

The hinge arm 1 is again fastened to the intermediate member 4 by means of a joint adjustment screw 7 which is mounted in a female thread of the hinge arm 1 and by means of a clamping screw 6 which also serves for depth adjustment. The clamping screw 6 projects through a slot in the hinge arm 1, and the joint adjustment screw 7 has a head 7' held in a slot in the intermediate member 4. The longitudinal slot forms the recess 9. By releasing the clamping screw 6, the hinge arm 1 can be displaced over the length of the longitudinal slot in the hinge arm 1 and, thus, be adjusted in the direction of the depth of the piece of furniture. The adjustment in the direction of the door joint is effected in a conventional manner by turning the joint adjustment screw 7.

The hinge arm 1 as well as the intermediate member 4 have U-shaped profiles. At its front, the intermediate member 4 is provided with a through bolt 63 which serves as a holding projection of the intermediate member 4. The mounting plate 2 has at its front a notch 53 into which the bolt 63 can be engaged so that it is held at the mounting plate 2.

At its rear end, the mounting plate 2 is also provided with a notch 54.

A tilting lever 5 is mounted on the rear end of the intermediate member 4. A hook-like projection 57 is formed on the tilting lever 5.

The tilting lever 5 is acted upon by a coil spring 58 which is mounted in a recess of the tilting lever 5 and has one end abutting on the hinge arm 1.

Figure 30:
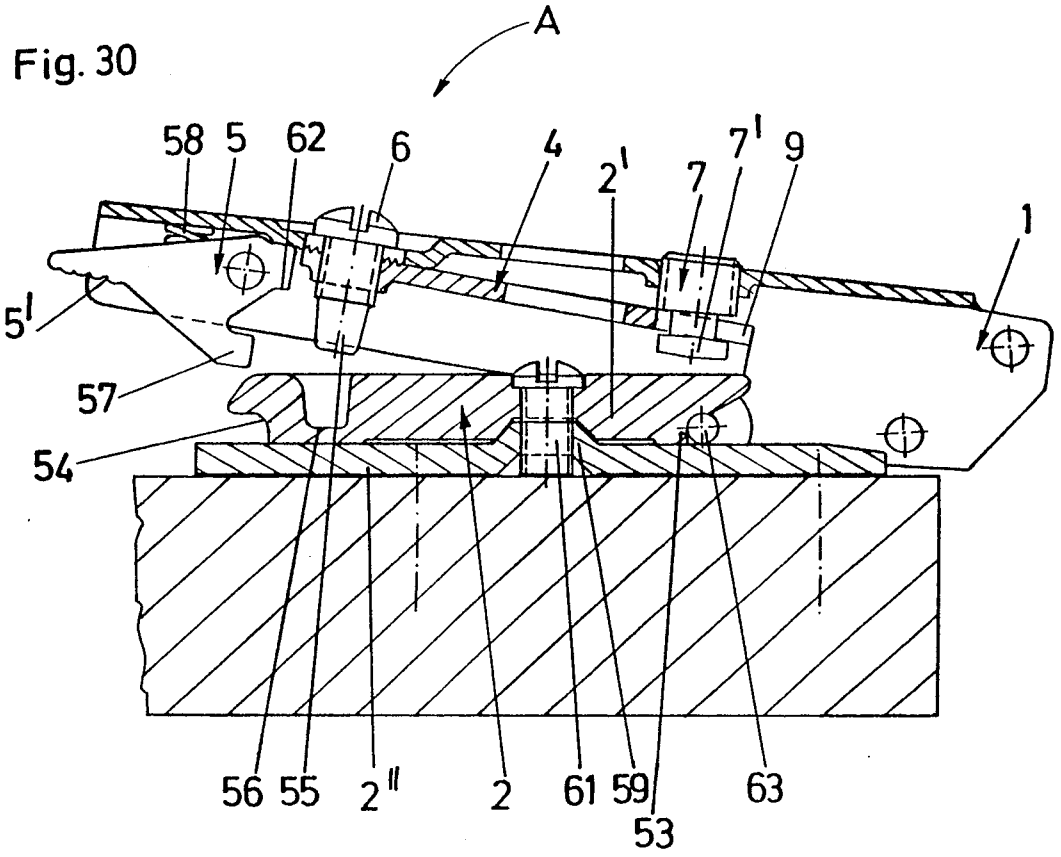
FIG. 30 is a longitudinal sectional view of a hinge and a mounting plate of a further embodiment shown in the position to the hinge arm being engaged in the mounting plate.
Figure 31:
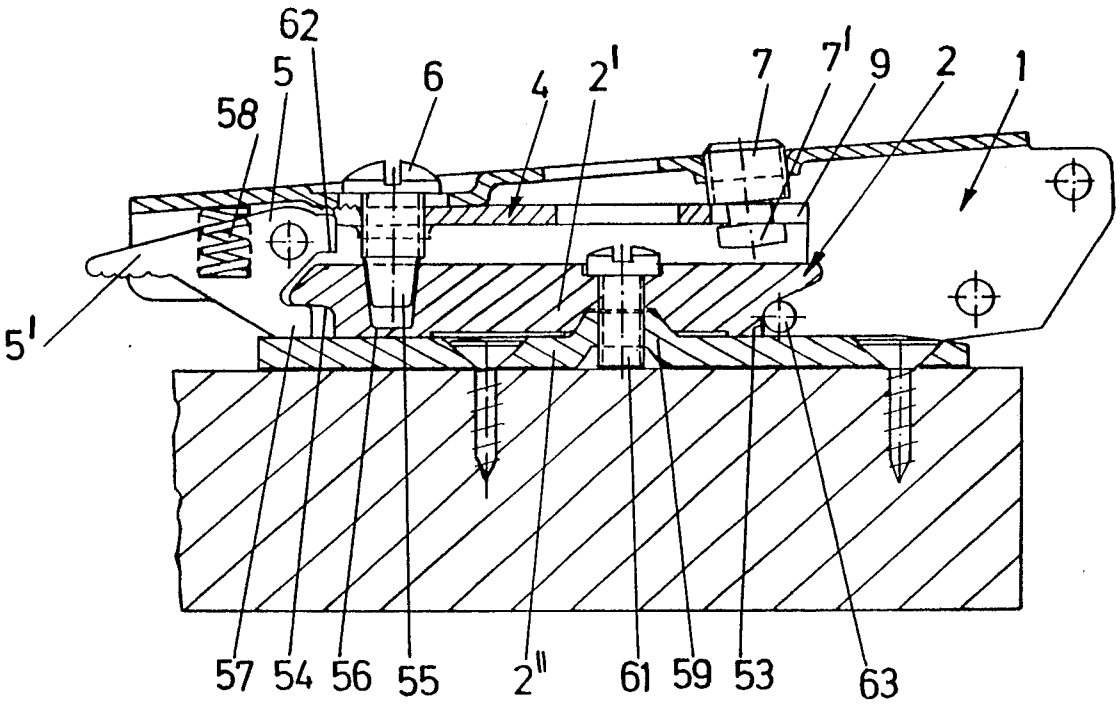
FIG. 31 is a longitudinal section of the hinge arm and the mounting plate of the same embodiment, the hinge arm being in the mounted positon.
Figure 32:
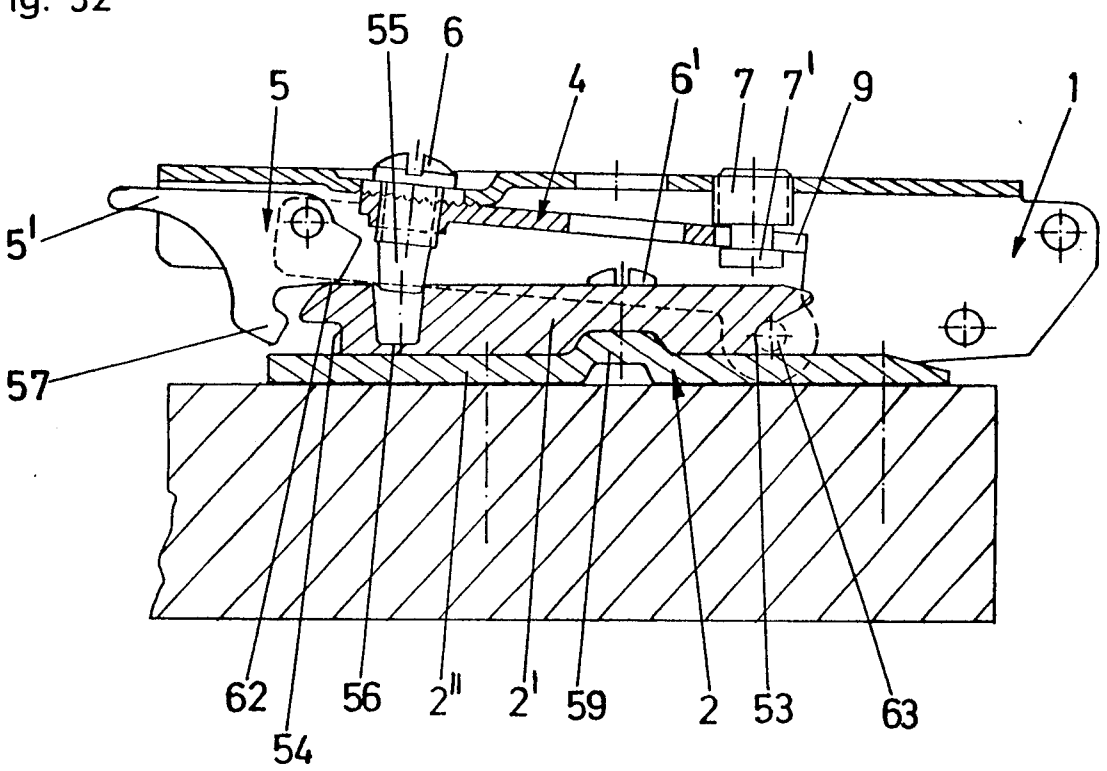
FIG. 32 is a longitudinal sectional view of the hinge arm and the mounting plate of the same embodiment, with an intermediate member thereof being released.

When the hinge arm 1 with the intermediate member 4 is pressed from the position shown in FIG. 30 into the position shown in FIG. 31, the hook-like projection 57 engages in the notch 54, and the hinge arm 1 is anchored to the mounting plate 2.

The clamping screw 6 for the depth adjustment has a centering portion 55 projecting into a corresponding recess or opening 56 in the mounting plate 2. The centering portion 55 is conical, and the opening 56 is funnel-shaped. Thus, the hinge arm 1 can be promptly placed in its correct position.

The distances between the pin 63 and the centering portion 55 and between the notch 53 and the opening 56 are chosen such that a slight bracing effect is produced when the intermediate member 4 is pressed onto the mounting plate. Hence, the intermediate member 4 is held on the mounting plate 2 without clearance.

The adjustment of the hinge arm 1 is, if necessary, effected in the afore-described manner.

A handle member 5' is formed on the tilting member 5. If the hinge arm 1 is to be released from the mounting plate 2, handle member 5' need only be lifted, whereupon the projection 57 moves out of the notch 54, and the hinge arm 1 with the intermediate member 4 can be lifted from the mounting plate 2.

Abutting surface or nose 62 at the tilting lever 5 facilitates such releasing operation. As can be seen from FIG. 32, the nose 62 presses onto the mounting plate 2 and acts as a lever. It is thus possible to release the centering shoulder 55 easily in spite of the bracing effect.

For vertical adjustment of the hinge arm 1, the clamping screw 6 is released, and an upper part 2' of the mounting plate 2 is displaced relative to a lower part 2'' thereof. Tilting of the hinge arm 1 is prevented by a guide 59. The clamping screw 6 is fastened when vertical adjustment has been effected.

The terms "upper", "lower" and "vertical" refer to the orientations in the drawings and not to the position of the hinge mounted on the piece of furniture.

In all embodiments, the hinge arm is directly or indirectly engaged at one end of the mounting plate and then turned about this pivot bearing, whereupon the other end snaps into a trap-like locking.

In most embodiments, the hinge arm is engaged at the end directed to the hinge link or hinge links. It is, however, also possible to provide the anchoring in such a way that the pivot bearing is arranged at the rear end of the hinge arm and the snap-in device at the end carrying the hinge link or links.

We claim:

1. A hinge comprising:

a mounting plate having at a first end thereof a partially cylindrical recess and having at a second end thereof a latching means;

a hinge arm;

an intermediate member adjustably supporting said hinge arm for mounting said hinge arm on said mounting plate, said intermediate member having a U-shaped configuration defined by two side flanges joined by a web;

a pin mounted between said two side flanges at a first end of said intermediate member, said pin having an outer circumference matching said partially cylindrical recess in said mounting plate, said pin fitting into said recess and thereby forming a pivot axis about which said intermediate member and said hinge arm are pivotable with respect to said mounting plate;

a pivot lever pivotally mounted between said side flanges at a second end of said intermediate member, said pivot lever having latching means to engage said latching means of said mounting plate when said intermediate member and said hinge arm are pivoted about said pivot axis toward said mounting plate and thereby to fasten said intermediate member to said mounting plate; and spring means for urging said pivot lever to a position such that said latching means thereof engages said latching means of said mounting plate, said pivot lever being movable against the force of said spring means to disengage said latching means of said pivot lever from said latching means of said mounting plate, such that said intermediate member and said hinge arm then are removable from said mounting plate.

2. A hinge as claimed in claim 1, wherein said web of said intermediate member has therein a slot open to said first end of said intermediate member, and further comprising a joint adjustment screw adjustably threaded through said hinge arm and having a slotted head fitting in said slot, such that rotation adjustment of said joint adjustment screw moves said hinge arm relatively toward or away from said intermediate member.

3. A hinge as claimed in claim 1, wherein said hinge arm has therein an elongated slot, and further comprising a clamping screw extending through said slot and threaded into said intermediate member, such that said hinge arm is adjustable longitudinally with respect to said intermediate member over the length of said slot.

4. A hinge as claimed in claim 3, wherein said mounting plate has therein a centering opening, and said clamping screw has a centering portion abuttingly projecting into said centering opening.

5. A hinge as claimed in claim 4, wherein said pivot lever has an abutting surface contacting said mounting plate upon movement of said pivot lever against the force of said spring means to disengage said latching means, and thereby facilitating such disengagement.

6. A hinge as claimed in claim 1, wherein said spring means comprises a torsion spring having a first leg acting on said intermediate member and a second leg acting on said pivot lever.

7. A hinge as claimed in claim 1, wherein said spring means comprises a coil spring acting between said hinge arm and said pivot lever.

8. A hinge as claimed in claim 1, wherein said mounting plate has a U-shaped configuration including a pair of side flanges positioned between said two side flanges of said intermediate member.

* * * * *